United States Patent [19]

Fortin

[11] Patent Number: 4,648,181

[45] Date of Patent: Mar. 10, 1987

[54] PRECISION LINOLEUM SEAM CUTTING TOOL

[76] Inventor: Conrad Fortin, 534 Main St., Van Buren, Me. 04785

[21] Appl. No.: 746,837

[22] Filed: Jun. 20, 1985

[51] Int. Cl.[4] ..... B26B 29/00

[52] U.S. Cl. ..... 30/293; 30/287; 30/294

[58] Field of Search ..... 30/287, 289, 290, 293, 30/294

[56] References Cited

U.S. PATENT DOCUMENTS 3,407,498 10/1968 Young ..... 30/293

3,613,239 10/1971 Porrelli ..... 30/293

FOREIGN PATENT DOCUMENTS 2031781 4/1980 United Kingdom ..... 30/287

*Primary Examiner*—James M. Meister

*Assistant Examiner*—Michael D. Folkerts

*Attorney, Agent, or Firm*—Daniel H. Kane, Jr.

[57] ABSTRACT

A precision linoleum seam cutting tool cuts the overlying layer of linoleum to be installed next to an underlying layer of linoleum previously installed on a floor to provide a flush straight flat seam in a single step. The elongate tool body is constructed and arranged for grasping and moving the tool in the elongate direction. A pair of adjustable spaced apart guides are mounted on the tool body with a first aiming guide at the lead end and a second blade guide at the trailing end where the linoleum scoring blade and cutting blade are positioned. The guides define channels or recesses for receiving the overlying or next layer of linoleum to be cut and installed and are formed with an edge follower for abutting against and riding along the edge of the underlying layer of linoleum for aiming and guiding the tool. The blades and guides are arranged on the tool body for cutting a seam edge along the overlying layer of linoleum which is flush with the edge of the underlying layer upon moving the tool with the edge followers abutting against and riding along the edge of the underlying layer.

20 Claims, 11 Drawing Figures

PRECISION LINOLEUM SEAM CUTTING TOOL

TECHNICAL FIELD

This invention relates to a new hand tool to be used in applying and installing linoleum surfaces for cutting and forming precision seams between adjacent layers or strips of linoleum. The invention is particularly applicable for precision seam cutting during installation of commercial, heavy-weight or inlay linoleum.

BACKGROUND ART

Commercial grade, heavy-weight or inlay linoleum is generally available in lengths, strips or layers six feet wide. The linoleum strip or layer is formed with a selvage edge which overlaps the previous strip or layer. The overlapping selvage edge is hand cut during installation in an effort to provide a seam of flush edges between adjacent layers or strips.

During installation of linoleum the linoleum adhesive bonding is first applied to the floor or other surface over the area under the first strip or layer of linoleum, the selvage edge of the first layer is pre-cut to provide a straight edge, and the first layer is applied to the adhesive bonding over the floor or other surface. The second layer or next layer is then placed dry on the floor or other surface prior to application of further adhesive bonding, with the selvage edge of the second layer overlapping the first layer. A recess tool is used for scoring, scratching or marking a cutting line along the overlapping selvage of the second layer flush with the straight edge of the first or previous layer.

The recess tool defines a channel or recess for receiving the overlapping selvage edge of the next or second layer and a knob or follower under the channel abuts against and rides along the straight edge of the underlying first or previous layer of linoleum for guiding the recess tool. A needle or pin set in the top of the recess tool scratches or scores the cutting line into the overlying layer of linoleum aligned flush with the straight edge of the underlying layer. The second layer is then removed and cut along the scratched or scored cutting line using a linoleum knife or utility knife, linoleum adhesive is applied on the floor or surface underlying the second layer, and the second layer is then applied on the adhesive layer and installed with the cut edges flush along the seam.

A disadvantage of the traditional method for cutting and laying linoleum is that several separate steps are required for installing each next layer. First the layer must be placed in position on the dry floor or other surface for scoring or scratching the cutting line using a recess tool. Second the layer to be installed is removed and cut by hand along the cutting line using the linoleum cutting or utility knife. Third the linoleum adhesive is applied to the floor or other surface under the area of the second strip and the second strip is applied to the adhesive layer with adjacent edges abutting and forming the seam between the adjacent layers. Another disadvantage is that hand cutting of the commercial, heavy-duty or inlay linoleum selvage edge along the scratched or scored cutting line using the traditional linoleum cutting knife tends to thicken the edge during cutting creating a ridge. The result is an undesirable raised edge or ridge at the seam which may capture or trap debris. Furthermore the thickening at the edge during cutting with the traditional inlay knife, linoleum knife or utility knife may itself be uneven causing an uneven seam and seam ridge.

OBJECTS OF THE INVENTION

It is therefore an object of the present invention to provide a new linoleum seam cutting tool which reduces the steps in cutting, applying and installing a second or next layer of linoleum adjacent to a first or previous layer of linoleum already installed to a single step.

Another object of the invention is to provide a precision linoleum seam cutting tool which incorporates thin blades for cutting commercial, heavy-weight or inlay linoleum without thickening the edge during cutting and without creating a ridge at the seam.

A further object of the invention is to provide a precision linoleum seam cutting tool which in one step cuts and applies the next overlying layer of linoleum so that it forms a precision seam flush with the seam of the underlying previous layer of linoleum already installed on the floor or other surface. The invention is intended to cut precision seams in the heavy-gauge, commercial, or inlay linoleum as well as of course in the lighter, cushion-floor, calendared vinyl linoleum flooring and surface covering.

DISCLOSURE OF THE INVENTION

In order to accomplish these results the present invention provides a precision linoleum seam cutting tool for cutting the overlying layer of linoleum to be installed next to an underlying layer of linoleum previously installed on a floor or other surface. The seam is cut after the overlying layer of linoleum is already applied to linoleum adhesive on the floor or other surface. According to the invention the cutting tool is provided with an elongate tool body constructed and arranged for grasping the tool body and moving the tool body in the elongate direction with a leading end and a trailing end. One or more blades are mounted on the tool body oriented in alignment with the elongate direction at or adjacent to the trailing end of the tool body.

The invention provides a pair of spaced-apart guides including a first aiming guide mounted at or adjacent to the leading end of the tool body and a second blade guide mounted at or adjacent to the trailing end of the tool body. Each guide defines a channel or recess for receiving the overlying layer of linoleum to be cut and installed. Each guide further includes a downward projecting edge follower or knob for abutting against and riding along the edge of the underlying layer of linoleum previously installed for aiming and guiding the tool. The blades and guides are arranged on the tool body with the blades in alignment with the edge followers for cutting a seam edge along the overlying layer of linoleum flush with the edge of the underlaying layer of linoleum upon moving the tool with the edge followers abutting against and riding along the edge of the underlying layer.

For cutting commercial heavy-gauge inlay linoleum the invention provides two blades, a first scoring blade and a second cutting blade mounted in sequence and in alignment with the elongate direction. A feature and advantage of the cutting tool is that relatively thin standard blades rather than heavy-duty blades can be used because of the rigidifying support provided by the tool body. As a result there is no thickening of the edge of the heavy-gauge linoleum during cutting and therefore debris-trapping ridges and uneven edges at the seams are avoided. The tool body is provided with a blade mounting surface perpendicular to the flat bearing surface of the tool body which bears against the overlying layer of linoleum. As a result the blades are mounted and maintained substantially at right angles to the first bearing surface and the overlying layer of linoleum to be cut and installed.

In a preferred embodiment of the invention each guide provides a second flat bearing surface for bearing against and moving over the underlying layer of linoleum previously installed. The guides may be constructed and arranged on the tool body so that the second flat bearing surface of the guides which bears against the underlying layer forms a slight angle relative to the first flat bearing surface of the tool body which bears against the overlying layer of linoleum. The angle is substantially equal to the angle formed by the overlying portion of the overlying layer of linoleum to be cut and installed with the flat underlying layer of linoleum previously installed. As a result the blade is maintained at right angles to the overlying layer of linoleum despite the angle between the two layers.

The edge follower of each guide generally comprises a projection which engages the straight edge of the underlying layer. According to another aspect of the invention the edge follower projection may comprise a fraction of a cylinder or cylindrical knob formed with a flat on one side edge for abutting against and engaging the edge of the underlying layer of linoleum when the tool is moving in the elongate direction. The fraction of the cylinder according to the invention depends upon the application. The projecting knob edge follower is formed in the configuration of a fraction of a cylinder greater than one half for appplication in seam cutting for heavy-gauge, commercial or inlay linoleum. A feature and advantage of this arrangement is that the leading edge of the fractional cylinder plows adhesive applied to the floor in two directions including the direction toward the edge of the underlying layer of linoleum for applying adhesive in the seam. This is the desirable approach for laying heavy-gauge, commercial or inlay linoleum.

For application in seam cutting of lightweight, cushion-floor or calendared vinyl linoleum, the edge follower projection on each guide is formed in the configuration of a fraction of a cylinder equal to or less than one half so that the leading edge of the cylinder plows adhesive applied to the floor away from the edge of the underlying layer of linoleum. This is desirable for the installation of cushion-floor or lightweight linoleum where the linoleum adhesive bonding agent is not applied in the seam rather a special seam adhesive is applied on top of the cushion floor filling the seam from above. For this application it is therefore desirable to keep the linoleum adhesive out of the seam.

According to a preferred embodiment the tool body comprises an elongate handle formed with the blade mounting surface and an elongate base support abutting against the blade mounting surface of the handle. A feature and advantage of this arrangement is that the blades mounted on the blade mounting surface are rigidified by the pressure from the elongate base support abutting against the blades and blade-mounting surface. The elongate handle block is formed with at least one outer grasping side and preferably two outer grasping sides forming an acute angle with the elongate direction of the elongate base support. The angular construction imparts a lateral component of force and maintains the edge followers against the straight edge of the underlying layer of linoleum upon grasping the tool by the handle block and moving the tool in the elongate direction.

The invention also provides for adjusting the aiming guide for moving the aiming guide edge follower back and forth orthogonally across the elongate direction of the tool body for adjusting and straightening the seam cutting direction of the tool. The blade guide is also adjustable for moving the blade guide edge follower back and forth across the elongate direction for expanding and contracting the seam width between the adjacent layers of linoleum.

Other objects, features and advantages of the invention are apparent in the following specification and accompanying drawings.

DESCRIPTION OF PREFERRED EXAMPLE EMBODIMENTS AND BEST MODE OF THE INVENTION

Figure 1:
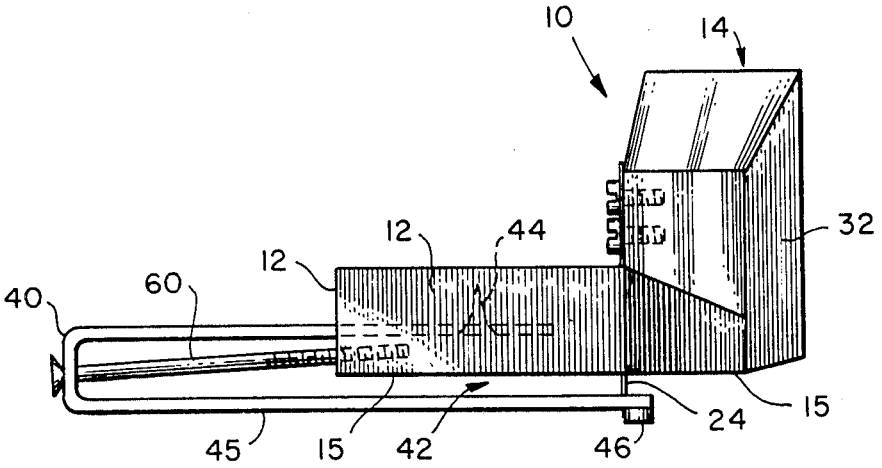
FIG. 1 is a front view of the tool showing the front end or leading end of the tool which is pulled in the direction of the leading end.

Referring to FIGS. 1–5, the precision seam cutting linoleum tool 10 includes an elongate tool body in this example provided by an elongate base support block 12 and an elongate handle block 14. The base support block 12 and handle block 14 in combination provide a first flat bearing surface 15 which bears against an overlying layer 6 of linoleum during operation of the tool. The tool is oriented with a leading end or direction 16 and a trailing end or direction 18 with the handle 14 providing a blade mounting surface 20 at or adjacent to the trailing end 18 of the tool. Mounted on the blade mounting surface 20 for example by screws 22 are a pair of blades including a first or leading scoring blade 24 and a second following or trailing linoleum cutting blade 25. The scoring blade 24 is, for example, a typical utility blade of the thinner standard gauge, thinner than typically used for cutting heavy-gauge linoleum. The scoring blade 24 is mounted with a projecting depth from the bottom of the tool at flat bearing surface 15 sufficient to score linoleum for example to a depth of for example one third to one half of the thickness of the heavy-gauge linoleum. The second blade 25 is typically a linoleum cutting blade such as a notched blade but of the thinner standard gauge, thinner than normally used in the heavy-duty linoleum cutting knives and tools.

The thinner blades may be used in the precision seam cutting tool according to the present invention because the blades are rigidified by the clapping of the base support block 12 to the handle block 14 by for example screws 26. The base support block 12 and handle block 14 may be formed for example of wood such as hardwood or alternatively may be formed of plastic, metal or other suitable material.

The handle block 14 is formed with a first grasping side 30 which may be for example a bevel angled surface forming a first larger acute angle with the elongate direction 16-18 of the tool body. The first outer grasping bevel angled surface 30 provides a surface for resting fingers against the tool body during operation of the tool. The handle block 14 is also formed with a second outer grasping side 32 forming a second smaller acute angle with the elongate direction 16-18 of the tool body for resting the palm of the hand against the tool body. Handle surfaces 34 and 34*a* can provide a thumb rest. The outer grasping sides or surfaces 30 and 32 are therefore constructed and arranged for resting the fingers and palm on the side of the tool and pulling the tool in the elongate leading direction 16. The acute angles formed by surfaces 30 and 32 impart during pulling a lateral component of force on the tool assuring that the edge followers hereafter described abut against and ride along the straight edge of the underlying linoleum layer 8.

At the leading edge 16 of tool 10 the aiming guide 40 is mounted across the longitudinal axis of the tool. The aiming guide 40 which resembles a U-shaped recess tool defines a channel or recess 42 for receiving the edge of an overlying or next adjacent layer 6 of linoleum and provides a second flat bearing surface 45 for bearing against and sliding over the underlying layer of previous layer 8 of linoleum already installed. Projecting from below the end of aiming guide 40 is the aiming guide follower or edge following knob 46. The inner edge of the aiming guide follower 46 abuts against and rides along or follows the straight edge 48 of the underlying layer, bottom layer or previous layer of linoleum already installed. The aiming guide 40 is arranged on the tool 10 so that the inner edge of the follower 46 is also in alignment with the scoring blade 24 and cutting blade 25 extending from the blade mounting surface 20 perpendicular to the first flat bearing surface 15 which bears against the upper layer or next layer 6 of linoleum to be installed.

At the trailing end or rear end 18 of tool 10 a blade guide 50 of configuration similar to the aiming guide 40 is mounted. The blade guide 50 also resembles a U-shaped recess tool and defines the channel or recess 52 for receiving the top layer or overlying layer 6 of linoleum to be installed and defines a further portion 55 of the second flat bearing surface for bearing against and sliding along the bottom or underlying layer 8 of linoleum already installed. A blade guide follower or edge following knob 56 is similarly mounted at the end of blade guide 50. The inner edge of the follower 56 similarly abuts against, rides along and follows the straight edge 48 of the underlying or bottom layer 8 of linoleum previously installed and is also aligned with the scoring blade 24 and cutting blade 25 mounted on the blade mounting surface 20.

The aiming guide 40 and blade guide 50 are rigidly secured to the base support block 12 by means of screws 44 and 54 which pass through slots in the respective guides so that upon loosening of the screws 44 and 54 the crosswise positioning of the respective guides 40 and 50 and respective followers 46 and 56 may be adjusted across the longitudinal axis of the tool. Adjustment and crosswise positioning of the aiming guide 40 is accomplished by tightening or loosening the long aiming screw 60 for extending and retracting the aiming guide follower 46 orthogonally across the longitudinal axis of the tool. The blade guide 50 is adjusted crosswise relative to the longitudinal axis of the tool by tightening and loosening the seam width screw 62 for extending and retracting the blade guide follower 56 orthogonally across the longitudinal axis of the tool.

Adjustment of the aiming guide 40 and aiming guide follower 46 has the effect of changing the angle of attack of the tool during cutting of the selvage edge from the overlying layer and is adjusted to achieve parallelism with the straight edge of the underlying layer by loosening the mounting screw 44 by inserting a screwdriver through the access slot 64 in the bottom of the aiming guide 40, turning the aiming guide screw 60 to achieve the desired parallelism, then retightening the mounting screw 44. With parallelism achieved, the blade guide 50 and blade guide follower 56 are adjusted so that the respective edges of the top and bottom layers or overlying and underlying layers of linoleum lie flush against each other in a flat closed seam. If the seam is too tight or too wide appropriate adjustment is made by first loosening the mounting screw 54 by inserting the screwdriver through the access slot 65 in the bottom of blade guide 50, then turning the seam width screw 62 to achieve the desired flush seam, then retightening the mounting or set screw 54.

With the tool properly tuned and adjusted straight, flush and flat seams are achieved in a single step according to the present invention. The linoleum adhesive bonding can be applied to the floor or other surface under the entire area including the area under the next adjacent layer or strip of linoleum. The next or second layer or strip is then applied in place with the selvage edge overlapping the first or previous layer or strip of linoleum already installed. The tool is positioned with the overlying layer 6 of linoleum inserted within the guide channels or recesses 42 and 52 of the aiming guide and blade guide, with the first bearing surface 15 resting on the overlying layer. The followers 46 and 56 engage and abut against the straight edge 48 of the bottom or underlying layer 8 of linoleum already installed. The second bearing surface provided by the undersurfaces 45 and 55 of the aiming guide and blade guide bear against the bottom layer 8 of linoleum. The tool is pulled in the direction of the operator with the followers 46 and 56 abutting against the straight edge 48 maintaining the true cutting line for a flush seam. The leading blade 24 scores the overlying layer of linoleum to for example ⅓ to ½ its depth while the aligned cutting blade 25 completes the cut, all with thin or standard blades which do not thicken the cut edge of the linoleum resulting in a straight flat and flush seam.

Figure 1A:
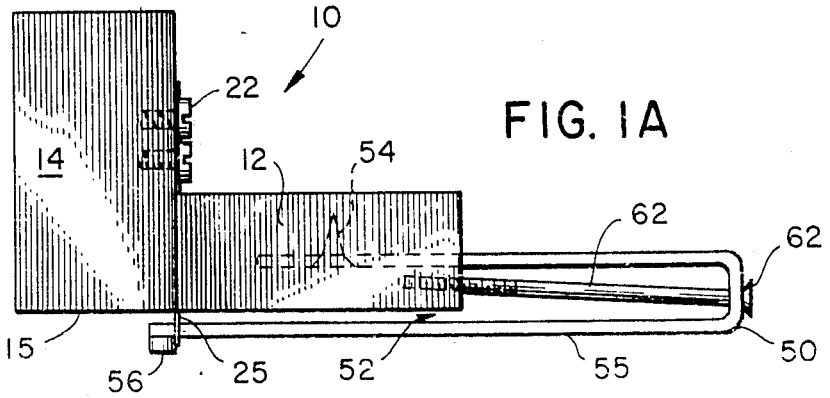
FIG. 1A is a back view or rear view of the tool showing the trailing end of the tool.
Figure 1B:
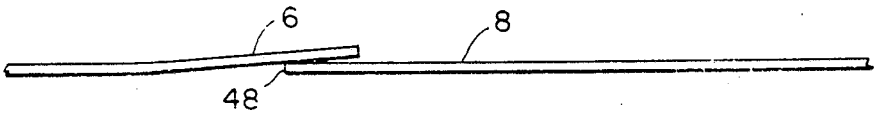
FIG. 1B is a side view of an overlying layer of linoleum to be cut.
Figure 2:
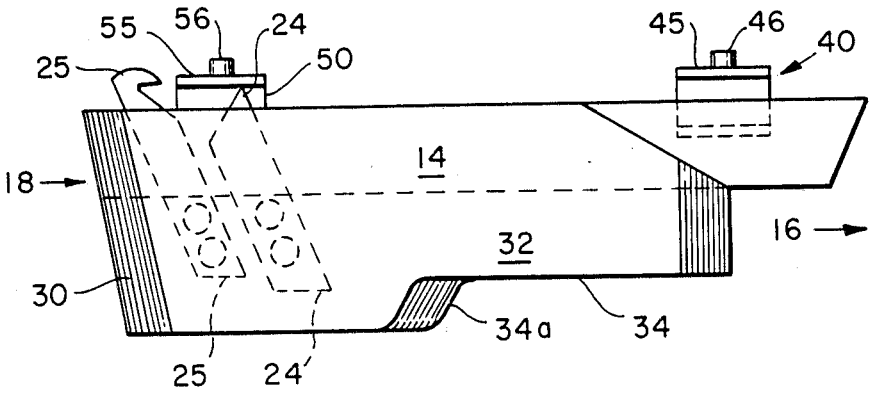
FIG. 2 is a side view of the tool looking at the handle side of the tool.
Figure 3:
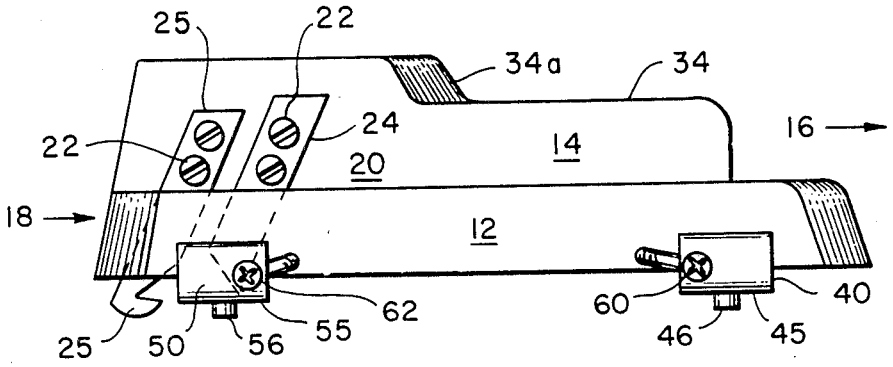
FIG. 3 is a side view of the tool looking at the base support side of the tool with the blades partially exposed on the blade mounting surface.
Figure 4:
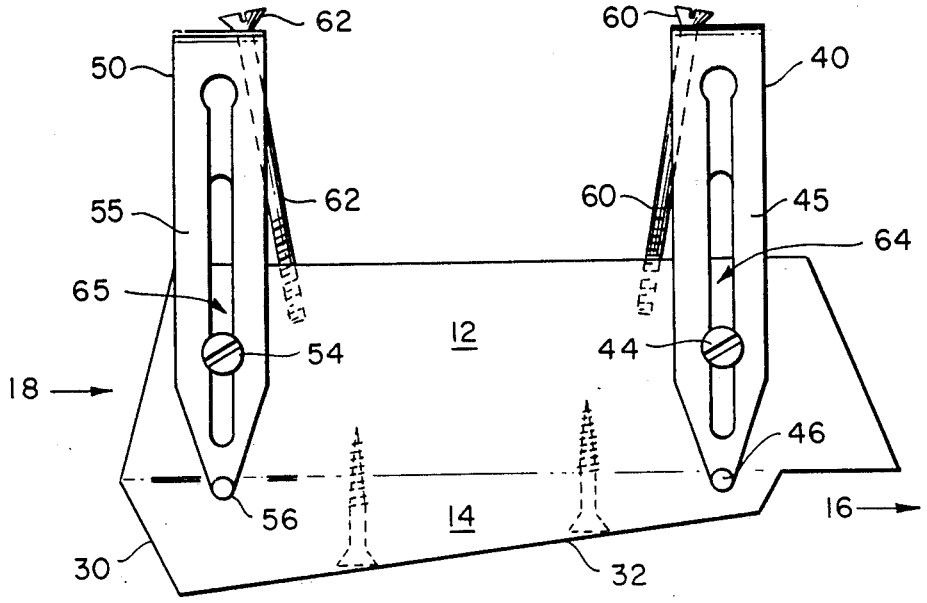
FIG. 4 is a plan view of the bottom of the tool showing the aiming guide and blade guide.
Figure 5:
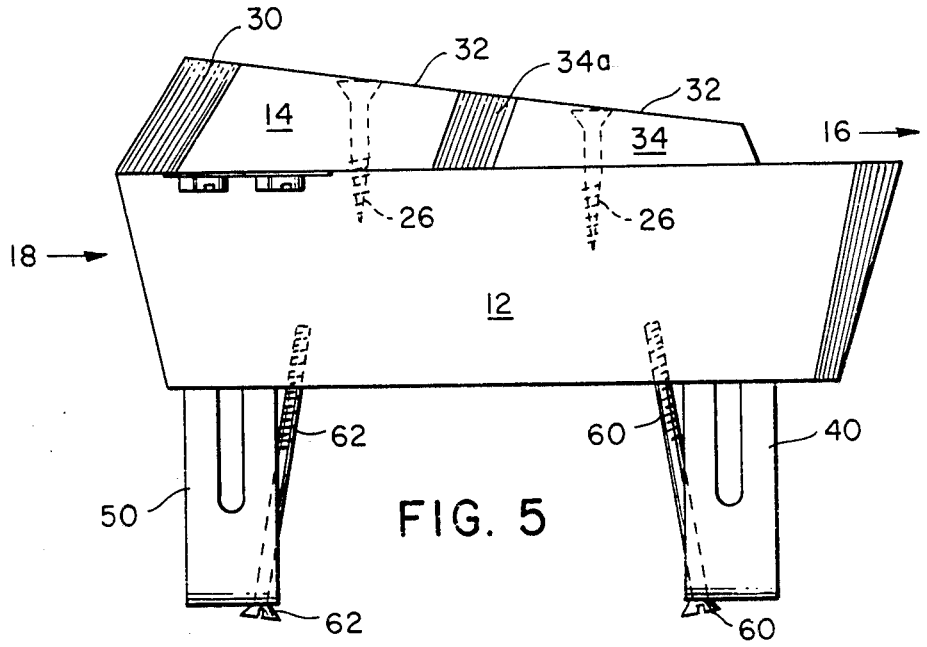
FIG. 5 is a plan view from the top of the tool.
Figure 6:
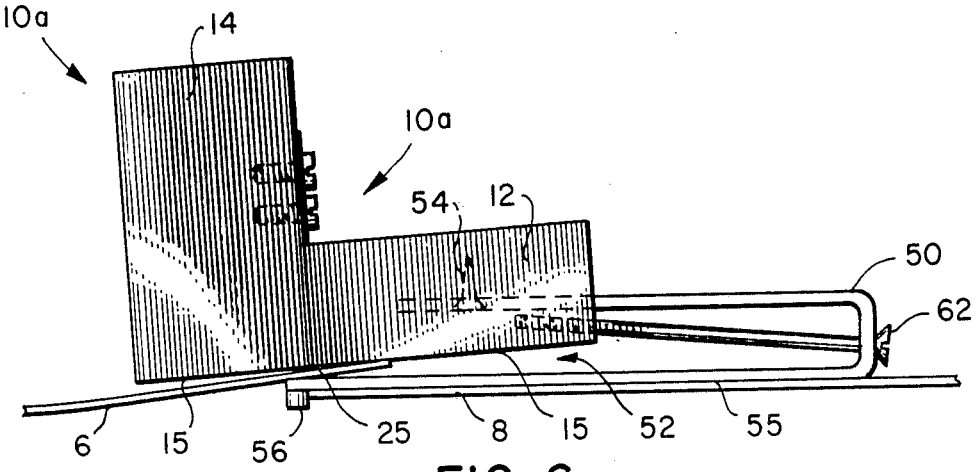
FIG. 6 is a rear view of the trailing end of an alternative embodiment of the invention with the first flat bearing surface of the tool body forming a slight angle with the second flat bearing surface of the guides, substantially equal to the angle between the overlapping portion of the overlying layer of linoleum and the underlying layer of linoleum.

A variation of the present invention is illustrated in FIG. 6 providing a rear view of the trailing end of the tool similar to FIG. 1A and corresponding elements are indicated by the same reference numeral. In FIG. 6 however the precision seam cutting tool 10A is formed with a slight angle between the first bearing surface 15 provided by the flat bottom of the base support block 12 and handle block 14 and the second flat bearing surface provided by the flat bottom or base 55 of the blade guide 50 and the flat bottom or base 45 of the aiming guide 40. This slight angle is achieved by the mounting angle of the respective blade guide and aiming guide on the base support block 12 of the tool 10A as illustrated in FIG. 6. The selected angle is approximately equal to the angle between the overlapping edge of the top or overlying layer 6 of linoleum and the bottom or underlying layer 8 of linoleum already installed. A feature and advantage of this slight angular similarity is that the first flat bearing surface 15 is maintained in a parallel flat bearing relationship against the overlying layer 6 of linoleum while the second flat bearing surfaces 45 and 55 are maintained in parallel flat bearing relationship on the bottom or underlying layer 8 of linoleum previously installed. By this expedient the cutting blades 24 and 25 are maintained in a perpendicular orientation relative to the overlying layer 6 and the edge to be cut.

Figure 6A:
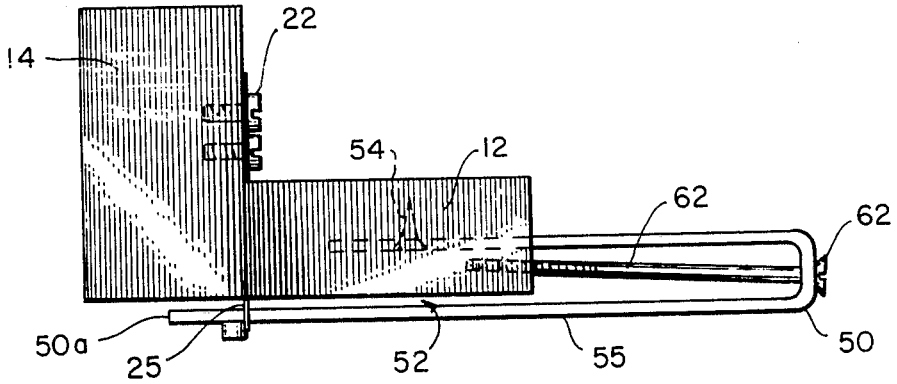
FIG. 6A is a rear view of the trailing end of another alternative embodiment of the invention.

Another variation to achieve the same result is illustrated in FIG. 6A also showing a rear view of the trailing end of the tool similar to FIG. 1A with corresponding elements indicated by the same reference numerals. In the embodiment, the first and second flat bearing surfaces 15, 45 and 55 form a straight 0° angle as in FIG. 1A. However the aiming guide 40 and blade guide 50 extend beyond the respective followers 46 and 56 a distance, for example approximately ⅜" (1 cm). This extension shown as blade guide extension **50*a* in FIG. 6A has the effect of straightening the overlying or top layer 6 of linoleum in the guide channel 52 so that the scoring and cutting blades are perpendicular to the layer 6** being trimmed and cut without having to introduce an angle between the first and second bearing surfaces.

Figure 7:
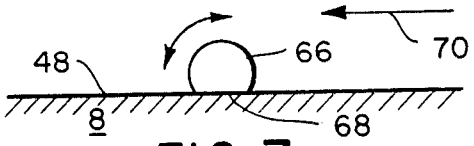
FIG. 7 is a fragmentary diagrammatic view of the edge follower projection in the configuration of a fraction of a cylinder greater than one half for application in cutting and installing heavy-gauge, commercial or inlay linoleum.
Figure 8:
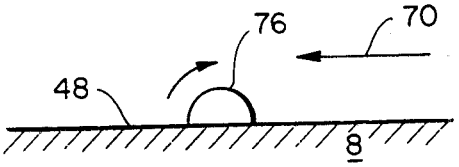
FIG. 8 is a fragmentary diagrammatic view of the edge follower projection in the configuration of a fraction of a cylinder of one half or less for application in cutting and installing lightweight, cushion-floor or calendared vinyl linoleum.

Further refinements in the precision seam cutting tool relating to the structure of the followers 46 and 56 are illustrated in FIGS. 7 and 8. An exemplary and preferred structure for the followers in applications of the tool for cutting heavy-gauge, commercial or inlay linoleum is illustrated in the fragmentary diagrammatic view of FIG. 7. In this example each of the followers 66 projecting from the bottom of the aiming guide and blade guide is in the configuration of a fraction of a cylinder with a flat 68 on the side abutting against the straight edge 48 of the underlying layer 8 of linoleum previously installed. According to this preferred embodiment for cutting of commercial gauge linoleum the leading edge of the follower 66 in the direction of travel of the tool indicated by arrow 70 "plows" linoleum adhesive bonding material applied to the floor or other surface in two directions both toward and away from the seam edge. Because it is desirable in the installation of commercial, heavy-weight or inlay linoleum to apply the linoleum adhesive bonding in the seam the cylinder fraction greater than ½ is selected. The quantity of bonding adhesive plowed or applied into the seam by the follower 66 may similarly be adjusted by adjusting the fraction of the cylinder and the position of the flat 68.

In FIG. 8 a follower 76 of different configuration is shown for application in cutting the lightweight, calendared vinyl or cushion linoleum. In this type of linoleum it is desirable to exclude the linoleum bonding adhesive from the seam and a separate seam compound is thereafter applied from above following installation of the adjacent strips or layers. According to the embodiment of FIG. 8, the follower 76 is in the configuration of a fraction of a cylinder in which the fractional portion is ½ or less so that any bonding adhesive along the edge 48 of the underlying or bottom layer 8 of linoleum already installed is plowed in one direction away from the seam when the precision linoleum seam cutting tool is pulled in the direction of travel indicated by arrow 70. Thus, when the projecting follower 76 is selected to be a fractional cylindrical configuration of fraction ½ or less the seam is cleared of linoleum adhesive for later application of the seam compound.

While the invention has been described with reference to particular example embodiments it is intended to cover all modifications and equivalents within the scope of the following claims.

I claim:

1. A precision linoleum seam cutting tool for cutting the overlying layer of linoleum to be installed next to an underlying layer of linoleum previously installed on a floor comprising:

an elongate tool body constructed and arranged for grasping the tool body and for moving the tool body in the elongate direction with a leading end and a trailing end;

blade means mounted on the tool body and oriented in alignment with the elongate direction adjacent to the trailing end of the tool body;

a pair of spaced apart guides comprising a first aiming guide mounted adjacent to the leading end of the tool body and a second blade guide mounted adjacent to the trailing end of the tool body;

each guide defining a channel for receiving an overlying layer of linoleum to be cut and installed, each guide comprising edge follower means for abutting against and riding along the edge of an underlying layer of linoleum previously installed for aiming and guiding the tool;

said blade means and pair of guides being arranged on the tool body for cutting a seam edge along the overlying layer of linoleum flush with the edge of the underlying layer of linoleum upon moving the tool with the edge followers abutting against and riding along the edge of the underlying layer;

tool aiming adjustment means comprising a coupling between the aiming guide and tool body for adjusting the aiming guide by moving the aiming guide and aiming guide edge follower back and forth orthogonally across the elongate direction of the tool body for adjusting and straightening the seam cutting direction of the tool;

seam adjustment means comprising a coupling between the aiming guide and tool body for adjusting the blade guide by moving the blade guide and blade guide edge follower back and forth orthogonally across the elongate direction of the tool body for expanding and contracting the seam width.

2. The tool of claim 1 wherein the blade means comprises a first scoring blade and a second cutting blade mounted in sequence and in alignment with the elongate direction.

3. The tool of claim 1 wherein the tool body comprises a first flat bearing surface for bearing against and moving over an overlying layer of linoleum to be cut and installed, and a blade mounting surface perpendicular to the first flat bearing surface for mounting said pair of blade means substantially at right angles to the first flat bearing surface and the overlying layer of linoleum to be cut and installed.

4. The tool of claim 3 wherein each guide comprises a second flat bearing surface for bearing against and moving over an underlying layer of linoleum previously installed, each guide being constructed and arranged on the tool body so that the second flat bearing surface of each guide forms a slight angle relative to the first flat bearing surface of the tool body substantially equal to the angle between the overlying portion of the overlying layer of linoleum to be cut and installed and the underlying layer of linoleum previously installed so that the blade means is maintained at right angles to the overlying layer of linoleum to be cut and installed.

5. The tool of claim 1 wherein the spaced apart guides are constructed to extend beyond the respective edge followers for straightening the overlying layer of linoleum so that it is perpendicular to the blade means.

6. The tool of claim 1 wherein each edge follower comprises a downward projection in the configuration of a fraction of a cylinder oriented with the cylinder axis in the vertical direction, said fraction of a cylinder being formed with a vertically oriented flat on one side for abutting against and engaging the edge of the underlying layer when the tool is moved in the elongate direction.

7. The tool of claim 6 wherein the fraction of the cylinder is greater than ½ so that the leading edge of the fractional cylinder plows adhesive applied to the floor in two directions including the direction toward the edge of the underlying layer of linoleum for application of adhesive into the seam during seam cutting of heavy gauge, commercial or in-lay linoleum.

8. The tool of claim 6 wherein the fraction of the cylinder is equal to or less than ½ so that the leading edge of the cylinder plows adhesive applied to the floor away from the edge of the underlying layer of linoleum for application in seam cutting for light weight, cushion floor, or calendared vinyl linoleum.

9. The tool of claim 1 wherein the tool body comprises an elongate base support formed with a blade mounting surface, and elongate handle means abutting against the blade mounting surface of the base support for rigidifying a blade means an mounted on blade mounting surface, said handle means being formed with at least one outer grasping side forming an acute angle with the elongate direction of the elongate base support for imparting a lateral component of force and maintaining the edge followers against the edge of the underlying layer of linoleum upon grasping the tool by the handle means and moving the tool in the elongate direction.

10. The tool of claim 1 wherein the tool body comprises handle means formed with at least one outer grasping side forming an acute angle with the elongate direction of the tool body, said handle means constructed and arranged so that upon grasping and moving the tool body in the elongate direction, a lateral component of force is imparted by said outer grasping side for maintaining the edge followers against the edge of the underlying layer of linoleum.

11. The tool of claim 10 wherein the handle means comprises a first outer grasping side forming a first larger acute angle with the elongate direction of the tool body for resting fingers against the tool body and a second outer grasping side forming a second smaller acute angle with the elongate direction of the tool body for resting the palm against the tool body, said first and second outer grasping sides being constructed and arranged for pulling the tool in the elongate direction and imparting said lateral component of force.

12. The tool of claim 2 wherein the cutting blade comprises a notch blade following the scoring blade.

13. The tool of claim 1 wherein the tool aiming adjustment means comprises a screw coupling between the aiming guide and tool body.

14. The tool of claim 1 wherein the seam adjustment means comprises a screw coupling between the blade guide and the tool body.

15. A precision linoleum seam cutting tool comprising:

an elongate base support formed with a flat bearing surface for bearing against and moving over an overlying layer of linoleum to be cut and installed, said base support also being formed with a blade mounting surface substantially perpendicular to the flat bearing surface, said elongate base support defining a leading end and a trailing end in said elongate direction;

elongate handle means ahutting against the blade mounting surface of the base support and formed with at least one outer grasping side forming an acute angle with the elongate direction of the base support for imparting a lateral component of force upon grasping and moving the tool by the handle means in the elongate direction;

a first scoring blade mounted adjacent to the trailing end of the elongate base support on the blade mounting surface;

a second cutting blade mounted on the blade mounting surface following the scoring blade at the trailing end of the elongate base support and in alignment with the scoring blade in the elongate direction;

aiming guide means mounted adjacent to the leading end of the elongate base support said aiming guide means defining a recess channel for receiving the overlying layer of linoleum to be cut and installed next to an underlying layer of linoleum previously installed, said aiming guide means comprising a first edge follower for abutting against and riding along the edge of the underlying layer of linoleum for aiming and guiding the tool;

blade guide means mounted adjacent to the trailing end of the elongate base support, said blade guide means defining a recess channel for receiving and accommodating the overlying layer of linoleum to be cut and installed next to an underlying layer of linoleum previously installed, said blade guide means comprising a second edge follower for abutting against and riding along the edge of the underlying layer of linoleum for spacing the blades and setting the tightness or looseness of the seam width between the overlying and underlying layers:

tool aiming adjustment means comprising a coupling between the aiming guide means and elongate base support for adjusting the aiming guide means by moving the aiming guide means and first edge follower back and forth orthogonally across the elongate direction of the base support for adjusting and straightening the seam cutting direction of the tool;

seam adjustment means comprising a coupling between the blade guide means and elongate base support for adjusting the blade guide means by moving the blade guide means and second edge follower back and forth orthogonally across the elongate direction of the base support for expanding and contracting the seam width;

whereby the tool may be grasped and moved along the edge of the underlying layer of linoleum previously installed for cutting the overlying layer along a precision seam edge flush with the edge of the underlying layer.

16. The tool of claim 15 wherein each edge follower comprises a fraction of a cylinder oriented with the axis of the cylinder in the vertical direction and formed with a vertical flat for abutting and following the edge of the underlying layer of linoleum previously installed.

17. The tool of claim 16 wherein the fraction of the cylinder is greater than ½ for plowing adhesive both toward and away from the edge of the underlying layer of linoleum upon grasping and moving the tool in the elongate direction for applying adhesive into the seam.

18. The tool of claim 15 wherein each of the aiming guide and blade guide comprises a second flat bearing surface, said elongate base support, aiming guide and blade guide being constructed and aranged so that the second flat bearing surface of the aiming guide and the blade guide forms a slight acute angle with the first flat bearing surface of the base support, said angle being substantially equal to the angle of the overlying portion of the overlying layer of linoleum relative to the underlying layer previously installed.

19. The tool of claim 15 wherein the tool aiming adjustment means and seam adjustment means comprise respectively a first screw coupling between the aiming guide means and base support and a second screw coupling between the blade guide means and base support.

20. A precision linoleum seam cutting tool for cutting the overlying layer of linoleum to be installed next to an underlying layer of linoleum previously installed on a floor comprising:

an elongate tool body constructed and arranged for grasping the tool body and for moving the tool body in the elongate direction with a leading end and a trailing end;

blade means mounted on the tool body and oriented in alignment with the elongate direction adjacent to the trailing end of the tool body;

first and second guide means defining a channel for receiving an overlying layer of linoleum to be cut and installed, said first and second guide means comprising respectively first and second spaced apart edge follower means at the leading end and trailing end respectively of the elongate tool body for abutting against and riding along the edge of an underlying layer of linoleum previously installed for aiming and guiding the tool;

said blade means and guide means being arranged on the tool body for cutting a seam edge along the overlying layer of linoleum flush with the edge of the underlying layer of linoleum upon movong the tool with the edge follower means abutting against and riding along the edge of the underlying layer;

aiming adjustment means comprising a coupling between the first guide means and tool body for moving the first edge follower means back and forth orthogonally across the elongate direction of the tool for adjusting and straightening the seam cutting direction of the tool; and seam width adjustment means comprising a coupling between the second guide means and tool body for moving the second edge follower means back and forth orthogonally across the elongate direction of the tool for expanding and contracting the seam width.

* * * * *